United States Patent [19]

Dillard

[11] 4,103,437

[45] Aug. 1, 1978

[54] KARATE COMBAT SHOE

[76] Inventor: Lawrence Michael Dillard, 2624 SW. 69th St., Oklahoma City, Okla. 73159

[21] Appl. No.: 771,819

[22] Filed: Feb. 24, 1977

[51] Int. Cl.[2] ..... A41D 17/00

[52] U.S. Cl. ..... 36/2 R; 36/106

[58] Field of Search ..... 36/1, 1.5, 2 R, 9, 71, 36/106, 114

[56] References Cited

U.S. PATENT DOCUMENTS

| | | | |
|---|---|---|---|
| 2,724,676 | 11/1955 | Randall et al. | 12/142 E |
| 3,667,140 | 6/1972 | Hunderford | 36/71 |
| 3,769,722 | 11/1973 | Rhee | 36/2 R |
| 4,008,531 | 2/1977 | Schonbrun et al. | 36/2 R |

*Primary Examiner*—Patrick D. Lawson

*Attorney, Agent, or Firm*—Robert M. Hessin

[57] ABSTRACT

Apparatus in the form of a foot gloving having a plurality of padded surfaces for use in Karate fighting. The apparatus consists of a shoe-form gloving which is laceable for secure positioning on the foot, and the shoe is constructed of tough, resilient material having uniform padding at all surfaces and, in addition, having padding on sides, heel and toe where the conventional Karate foot blows make contact.

5 Claims, 5 Drawing Figures

KARATE COMBAT SHOE

BACKGROUND OF THE INVENTION

1. Field of the Invention

The invention relates generally to a Karate combat foot cover and, more particularly, but not by way of limitation, it relates to an improved Karate boxing shoe having padding throughout with additional padding at strike impact locations.

2. Description of the Prior Art

To Applicant's knowledge, the prior art includes no form of Karate foot glove which is constructed in the manner of the present invention. Heretofore, competitive Karate combat has of necessity sought ways to pad the striking foot not only to protect the opponent but to protect the kicker as well. In one instance, this has taken the form of a simple sheathing of relatively thick foam material which was then simply tied or otherwise secured about the competitor's ankle, and which sheathing was poorly fit to the foot and oftentimes could hamper the combatant's foot moves.

SUMMARY OF THE INVENTION

The present invention contemplates a Karate combat shoe which is sufficiently padded throughout and bears additional padding at strike areas much in the manner of a boxing glove. In a more limited aspect, the invention consists of a shoe which is laceable about the combatant's foot to entirely cover the foot and ankle except for the foot bottom. The bottom of the shoe includes elastic retaining straps as well as toe positioning straps to maintain the shoe down over the foot, and the shoe includes extra padded sectors at the instep, each side and the heel thereof.

Therefore, it is an object of the present invention to provide a Karate combat shoe which is formed to fit to the foot yet amply padded to provide requisite protection to combatants.

It is also an object of the invention to provide a combat shoe which embodies sufficiently thick padding covering all Karate foot strike areas.

Finally, it is an object of the present invention to provide a Karate combat shoe which is safe yet effective for use in competitive Karate combat.

Other objects and advantages of the invention will be evident from the following detailed description when read in conjunction with the accompanying drawing which illustrates the invention.

DETAILED DESCRIPTION OF THE PREFERRED EMBODIMENT

Figure 1:
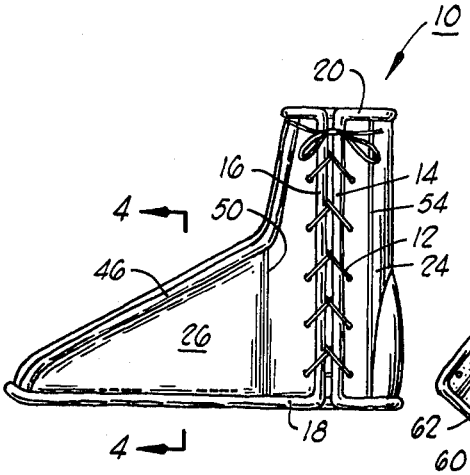
FIG. 1 is a side view in elevation of a right foot combat shoe.

FIG. 1 illustrates a side view (inside) of a right combat shoe 10 having lacing 12 extending vertically along the inside of the combatant's ankle to maintain combat shoe 10 in operative position. The combat shoe 10 is constructed of resilient, light gauge leather or the like on the outer surfaces, with foam rubber, plastic or other suitable forms of resilient padding material retained within by stitching. The extremities of the shoe 10 terminate in conventional edge hems such as heel hem 14, side hem 16, bottom hem 18 and ankle hem 20. Such edge hemming is formed in conventional manner in interlock with adjoining panels to provide a resilient edge which is free from any jagged or coarse surfaces.

Figure 2:
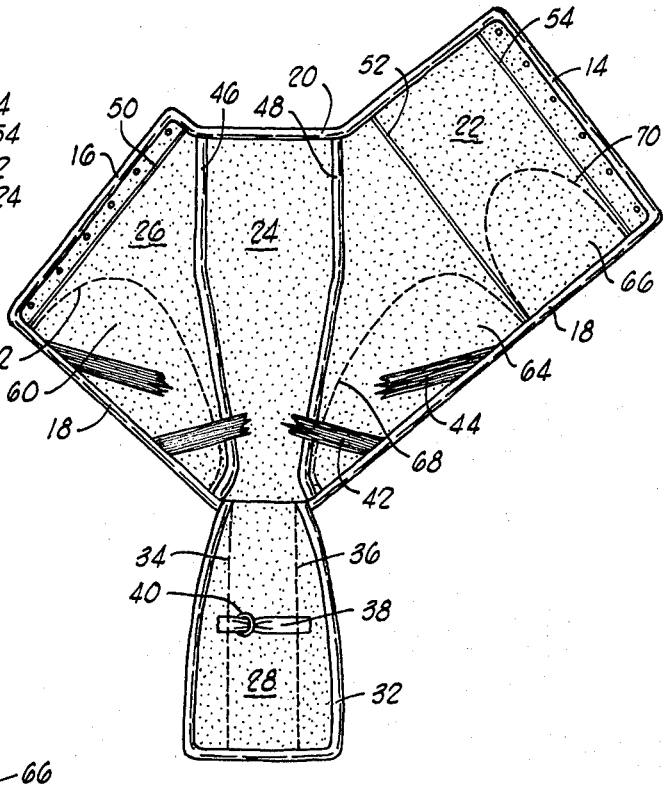
FIG. 2 is a plan view of the combat shoe in lay out form.
Figure 3:
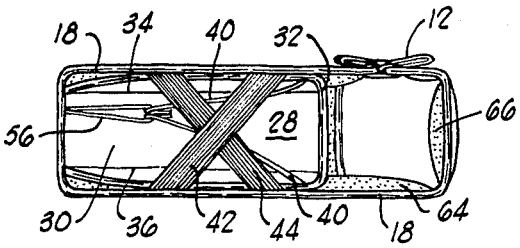
FIG. 3 is a bottom view of the combat shoe.
Figure 5:
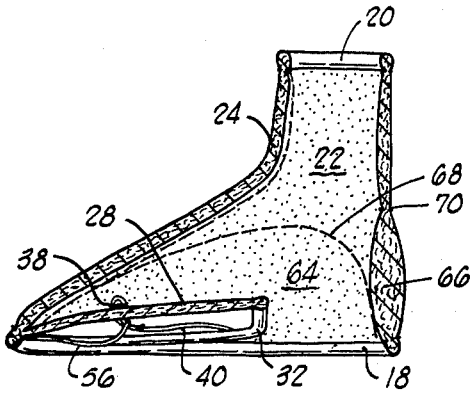
FIG. 5 is a vertical cross-section through the combat shoe as depicted in FIG. 1.
Figure 4:
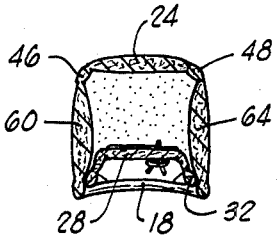
FIG. 4 is a section through lines 4-4 of FIG. 1.

FIG. 2 illustrates the shoe 10 in lay out form wherein all of the interior of outside panel 22, instep panel 24, inside panel 26 and tongue 28 are formed of an absorbent cotton material thereby contributing both to comfort and ventilation. Referring also to FIGS. 3, 4 and 5, the interior of tongue panel 28 is also formed with interior padding and leather covering on the opposite side to define an instep padding when in operative position. Tongue 28 is also defined by a hemmed edge 32 and parallel stitches 34 and 36 extend lengthwise to maintain interior padding position. A folded cotton strap 38 is secured by stitches 34 and 36 to provide an anchoring point for a toe band 40, as will be further described. A pair of diagonally opposed elastic straps 42 and 44 provide resilient positioning over the sole of the combatant's foot.

Joinder of the outside panel 22, instep panel 24 and inside panel 26 is made utilizing overlap stitched strips 46 and 48 of about one inch width. Double stitch lines 50, 52 and 54 serve to provide reinforcement of the lacing hems 14 and 16 and corner bends while also further strengthening the positioning of internal padding.

As shown in FIG. 3, diagonal straps 42 and 44 constitute bottom support for the shoe 10 while a toe loop 40 as anchored on tongue panel 28, is led through a retaining loop 56 as anchored by sewing within hem edge 18, and to be led back for anchoring on opposite sides of hem edge 32 of tongue 28. See also FIG. 5.

While the entire interior of all shoe panels is filled with uniformly thick resilient padding, e.g., $\frac{3}{4}$ inch foam rubber sheet, the strategic kick impact areas receive additional padding in accordance with the desired operational effect. These padding amounts may be varied in thickness and resiliency in accordance with the requirements of different Karate class combat. In the present design, the additionally padded areas include an additional thickness of resilient material on the order of $\frac{3}{4}$ inch. Thus, additional inside pad material may be included within inside pad 60 as maintained by pad stitching 62, and additional padding material is included at outside pad 64 and heel pad 66 as maintained by respective pad stitches 68 and 70. See also FIG. 4.

In operation, the unlaced shoe 10 is inserted over the foot such that resilient straps 42 and 44 rest beneath the foot sole and the double strand of elastic loop 40 is brought between the first two toes of the foot. Thereafter, the shoe is laced up on the inside, drawing the elastic lacing 12 tight for securing. The left shoe is put on in identical manner with its respective lacing on the inside and the combatant is then ready for Karate combat. All kicking surfaces of the foot are padded so that the combatant can deliver full force kicking blows with much less possibility of injury to the kicker or his opponent. Thus, instep tongue 28 provides additional instep padding while side kick padding is provided by inside pad 60 and outside pad 64 and heel kicks are cushioned by the heel pad 66.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A protective foot covering for use in Karate combat, comprising:

resilient panel means having a bottom edge and being disposed to provide ankle top covering around the inside, instep, outside and heel of the foot;

resilient securing means maintaining said panel means around said foot;

resilient strap means affixed to the bottom edge of said panel means to extend across the sole of the foot;

a plurality of additional resilient padding means retained within said panel means at each of the inside sector, the outside sector and the heel sector thereof; and a tongue flap of padded consistency which is secured to said panel means bottom edge and foldable beneath said instep sector for positioning adjacent the foot instep to provide additional padding.

2. A protective foot covering as set forth in claim 1 which is further characterized to include:

toe strap means for securing said tongue flap to the first two toes of the foot.

3. A protective foot covering as set forth in claim 1 wherein said resilient panel means comprises:

a unitarily constructed panel having interior padding, outer cover and inner cover wherein said panel is shaped to wrap in general conformance about the inside, instep, outside and heel of the foot for secure affixure in circumphery thereof.

4. A protective foot covering as set forth in claim 3 wherein said plurality of additional resilient padding means comprises:

padding means secured by stitching adjacent the panel means bottom edge at each of the inside, outside and heel portions of said panel means.

5. A protective foot covering as set forth in claim 4 which is further characterized to include:

toe strap means for securing said tongue flap to the first two toes of the foot.

* * * * *